US009444210B2

(12) United States Patent
McCaskey

(10) Patent No.: US 9,444,210 B2
(45) Date of Patent: Sep. 13, 2016

(54) WIRE TERMINATING TOOL

(71) Applicant: Charles McCaskey, Chardon, OH (US)
(72) Inventor: Charles McCaskey, Chardon, OH (US)
(73) Assignee: Charles McCaskey, Chardon, OH (US)

( * ) Notice: Subject to any disclaimer, the term of this patent is extended or adjusted under 35 U.S.C. 154(b) by 250 days.

(21) Appl. No.: 14/255,428

(22) Filed: Apr. 17, 2014

(65) Prior Publication Data

US 2014/0310953 A1 Oct. 23, 2014

Related U.S. Application Data

(60) Provisional application No. 61/812,911, filed on Apr. 17, 2013.

(51) Int. Cl.
*B23P 19/00* (2006.01)
*H01R 43/00* (2006.01)
*H01R 43/01* (2006.01)

(52) U.S. Cl.
CPC ..... *H01R 43/015* (2013.01); *Y10T 29/53217* (2015.01)

(58) Field of Classification Search
CPC .. H01R 43/015; H01R 13/629; H01R 13/62; H01R 9/2416; Y10T 29/49174; Y10T 29/5151; Y10T 29/53217; Y10T 29/53257; Y10T 29/53222; Y10T 29/53243; Y10T 29/53235
USPC ..... 29/755, 566.3, 566.4, 749, 750, 751, 29/753, 758
See application file for complete search history.

(56) References Cited

U.S. PATENT DOCUMENTS 3,628,202 A 12/1971 Brown et al.
3,708,852 A 1/1973 Mason
3,742,571 A 7/1973 Brehm
3,758,935 A 9/1973 Long et al.
3,886,641 A 6/1975 Davis
3,898,724 A 8/1975 Conorich
4,180,904 A 1/1980 Nijman
4,349,944 A 9/1982 Fickes
4,567,639 A 2/1986 Fasano
4,642,874 A 2/1987 Litehizer, Jr.
4,656,725 A 4/1987 Knickerbocker
5,561,898 A 10/1996 White et al.
5,628,105 A 5/1997 Fallandy et al.
5,836,069 A 11/1998 Fallandy et al.
5,887,333 A * 3/1999 Clark ..... H01R 43/015 29/566.4
6,401,325 B1 6/2002 Fidtje
6,601,285 B1 * 8/2003 Jonker ..... H01R 43/015 29/566.3
6,729,902 B2 5/2004 Martich
7,073,245 B2 7/2006 Alexander et al.
7,103,968 B2 9/2006 Karrasch
2010/0031492 A1 2/2010 Lee et al.

* cited by examiner

*Primary Examiner* — Thiem Phan
(74) *Attorney, Agent, or Firm* — Eschweiler & Associates, LLC

(57) ABSTRACT

A wire terminating tool has a handle and a positioning member coupled to the handle. The positioning member has a plurality of notches. A wire retention member is retractably slidingly coupled to the handle. The wire retention member has a plurality of wire engagement slots, wherein in a load position, the wire retention member selectively secures each of the wires in a respective one of wire engagement slots. When in an unload position, the wire retention member is retracted, therein transferring the wires from the wire retention member to a plurality of terminals of a termination block via the notches in the positioning member. A seating apparatus seats the wires in the terminals, therein providing a metal-to-metal contact between the wires and terminals. A cutting apparatus cuts the wires by a roller cutter, diagonal cutter, blade, and shear operably coupled to the handle.

20 Claims, 17 Drawing Sheets

WIRE TERMINATING TOOL

REFERENCE TO RELATED APPLICATION

This application claims priority to U.S. Provisional Patent Application Ser. No. 61/812,911 which was filed Apr. 17, 2013, entitled, WIRE TERMINATING TOOL, the entirety of which is hereby incorporated by reference as if fully set forth herein.

FIELD

The present disclosure relates generally to network and telecommunications installation tools, and more particularly, to a tool for concurrently positioning a plurality of wires of a twisted pair cable in a termination block and for subsequently seating and cutting said plurality of wires.

BACKGROUND

In the telecommunications cabling industry, it is a common task to route voice and data telecommunication wires, such as twisted pair cables, between various termination points throughout a building or area, wherein the cables connect one terminal to another. Standard commercially-available Insulation Displacement Connector (IDC) type bifurcated terminals, also called terminal blocks, such as the commonly used 110-style block, are typically used to provide an interconnection between electronic equipment and work area outlets for electrically conductive data transfer media (hereinafter also referred to as "cable"), such as unshielded twisted pair cable ("UTP"). UTP is a popular and widely used type of data transfer media for either voice or data communications, and is commonly used for Local Area Networks ("LANs") and other in-building voice and data communications applications.

The terminal block provides an electrical joining or connection of a cable to other devices, hardware, or cables, wherein the terminal block acts as a transfer point. The terminal block comprises a dielectric block having a plurality of electrical termination locations defined therein (hereinafter referred to as "terminals"), wherein the terminals have engagements for securing individual signal-carrying elements (hereinafter referred to as "wires") of one or more cables. Conventional terminal blocks are often integrated into a what is known as a "patch panel", wherein the terminal block facilitates an electrical connection between the terminated cable and another device or piece of hardware connected to the patch panel by a second cable or "patch cord". Once a cable is terminated or electrically connected to the patch panel via the electrical connection of the wires to the terminal block, the patch panel generally permits interchangeable interconnection of various devices and cables, thus simplifying cabling to the individual devices.

Conventionally, the individual wires of the cable are placed by hand in individual terminals or blades of a terminal block, and an impact tool or "punchdown" tool is subsequently utilized to cut and seat the individual wires in the terminal blocks. A variety of impact tools are available to installers within the telecommunications industry, wherein the impact tools are configured for seating and cutting the individual wires in the termination blocks. A typical impact tool comprises a handle and a head utilized in cutting and seating individual wires positioned in a terminal. An axially translatable hammer is provided within the handle, wherein the hammer is typically biased by a compression spring to strike the head. As an installer grips the handle and pushes it against a wire already individually positioned in the terminal, a hammer release element within the handle is moved into alignment with the hammer travel path, such that the compression spring releases its energy, thus causing the hammer to rapidly impact the cutting head, therein cutting the end of the wire and seating the wire in the terminal.

Such use of the aforementioned impact tools is common; however, the individual wires need to be already placed in the terminals into which they are to be seated. In a typical cable having multiple twisted-pair wires, for example, the installer will manually place the individual wires in their respective terminals by hand, and then follow the placement with the cutting and seating provided by the impact tool. Often times, however, the terminals are located in a terminal block that is difficult to reach due to other equipment (e.g., routers, switches, etc.) being in the way, or the terminal block is not the line of sight from the viewpoint of the installer. As a consequence, it is often time-consuming and labor-intensive for the installer to properly position the individual wires in such a limited environment, thereby increasing the cost of installation of telecommunications or network equipment. Further, it is often cumbersome to manually position more than one wire at a time prior to cutting and seating.

SUMMARY

The present disclosure overcomes the limitations of the prior art and provides inventive an apparatus and method for installing telecommunications wiring. In particular, the present disclosure provides a tool for pre-positioning a plurality of wires in a terminal block prior to a cutting and seating thereof, wherein the tool retains the plurality wires for positioning within the terminal block. Upon successful positioning, the tool is further configured to seat and cut the individual wires in respective terminals of the terminal block.

In accordance with one exemplary aspect, the wire terminating tool comprises a handle and a positioning member operably coupled to the handle, wherein the positioning member comprises a plurality of notches. A wire retention member is retractably coupled to the handle and configured to slidingly translate with respect to the positioning member between a load position and an unload position. The wire retention member, for example, comprises a plurality of wire engagement slots, and wherein in the load position, the wire retention member is configured to selectively secure each of the plurality of wires thereto in a respective one of the plurality of wire engagement slots. In the unload position, the wire retention member is retracted with respect to the positioning member, therein transferring the plurality of wires from the wire retention member to the plurality of notches in the positioning member. The positioning member is configured to position each of the plurality of wires in a respective terminal of the termination block.

According to one example, the wire terminating tool comprises a seating apparatus configured to seat the plurality of wires in the plurality of terminals, respectively, therein providing a metal-to-metal contact between the respective plurality of wires and plurality of terminals. The seating apparatus, for example, comprises a seating member respectively associated with each of the plurality of notches. Each seating member is operably coupled to the positioning member and configured to seat a respective one of the plurality of wires in the respective terminal concurrent with the retraction of the wire retention member with respect to the positioning member.

The handle, for example, comprises a first portion and a second portion, wherein the first portion and second portion generally retain the wire retention member in sliding engagement thereto, and wherein the seating apparatus is operably coupled to one or more of the first portion and second portion of the handle. Each seating member can comprise one or more of a pin, bar, plate, and extrusion fixedly coupled to one or more of the first portion and second portion of the handle.

In accordance with another exemplary aspect, the wire terminating tool further comprises a cutting apparatus operably coupled to the handle and configured to cut the plurality wires at a predetermined position. The cutting apparatus, for example, comprises a cutter associated with each of the plurality of notches, respectively. Each cutter, for example, is operably coupled to the positioning member and configured to cut a respective one of the plurality of wires subsequent to the retraction of the wire retention member with respect to the positioning member. In another example, the cutting apparatus is operably coupled to one or more of the first portion and second portion of the handle.

Each cutter, for example, comprises one or more of a roller cutter, diagonal cutter, blade, and shear operably coupled to one of the first portion and second portion of the handle. An activator, for example, is further operably coupled to each cutter, wherein the activator is configured to translate each cutter with respect to the positioning member, therein cutting each respective wire. The activator can comprise one or more of a motor, gears, and linkages operably coupled to each cutter. In one example, a power source is operably coupled to the activator, wherein the power source comprises a battery removably positioned within the handle. Alternatively, the activator comprises a lever operably coupled to the handle, wherein the lever is manually actuated by a user.

In one particular example, each cutter comprises one or more shears, wherein the cutting apparatus further comprises a trigger mechanism and a motor having a shaft operably coupled to each of the one or more shears via a plurality of gears and linkages. The trigger mechanism selectively actuates the motor causing a rotation of the shaft, wherein the rotation of the shaft pivots each of the one or more shears about a respective axis, therein cutting each respective wire. A battery, for example, is further operably coupled to the motor, wherein the battery is removably positioned within the handle.

To the accomplishment of the foregoing and related ends, the disclosure comprises the features hereinafter fully described and particularly pointed out in the claims. The following description and the annexed drawings set forth in detail certain illustrative embodiments of the disclosure. These embodiments are indicative, however, of a few of the various ways in which the principles of the disclosure may be employed. Other objects, advantages and novel features of the disclosure will become apparent from the following detailed description of the disclosure when considered in conjunction with the drawings.

DETAILED DESCRIPTION

Figure 1A:
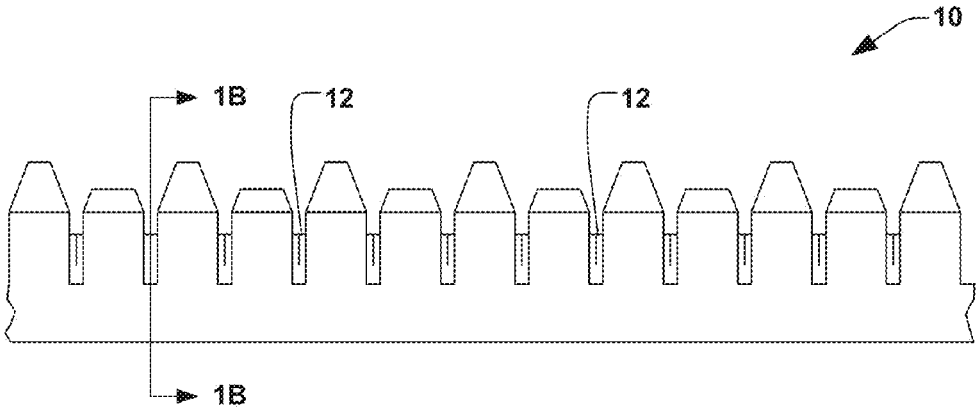
FIGS. 1A and 1B respectively illustrate front and side views a conventional terminal block according to one example.

The present disclosure is directed generally toward tools for use in the telecommunications industry, and more particularly, to a tool configured to selectively retain individual wires of a twisted pair cable prior to termination at a terminal block, as well as subsequent seating and cutting of said wires. Accordingly, the present disclosure will now be described with reference to the drawings, wherein like reference numerals may be used to refer to like elements throughout. It should be understood that the description of these aspects are merely illustrative and that they should not be interpreted in a limiting sense. In the following description, for purposes of explanation, numerous specific details are set forth in order to provide a thorough understanding of the present disclosure. It will be evident to one skilled in the art, however, that the present disclosure may be practiced without these specific details.

Figure 1B:
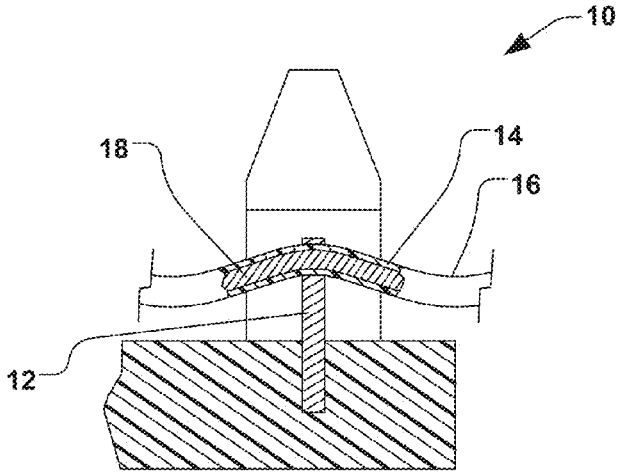

FIGS. 1A and 1B illustrate an exemplary terminal architecture or punch block 10 (also called a punchdown block, punchblock, termination block, or quick-connect block) often used in telecommunications and network communications arenas. The punch block 10, for example, comprises one or more sets of Insulation Displacement Connector (IDC) type bifurcated terminals 12, the construction of which will be understood by one of ordinary skill in the art. The IDC terminals 12, for example, are configured to cut through an insulation coating 14 of a wire 16, as illustrated in FIG. 1B, when the wire is "punched down" or forcibly connected to the terminal by a conventional "punch down" tool (not shown), therein generally fixing the wire in position and maintaining electrical contact between a conductor 18 of the wire and the IDC terminal 12, as will be understood by one of ordinary skill in the art.

The punch block 10 and associated IDC terminals 12, for example, are integrated into a patch panel (not shown) configured to selectively connect or "patch" various devices (e.g., a network router, switch, etc.—not shown) thereto, as will be understood by one of ordinary skill in the art. Accordingly, the punch block 10 of FIGS. 1A and 1B is configured to accept a plurality of wires 16 (e.g., a plurality of twisted-pair wires) defining a cable (e.g., a cat-5 or cat-6 cable), wherein the punch block 10 electrically connects the plurality of wires to the respective device (not shown). It should be noted that while specific devices may be named or described herein, the present disclosure is not limited to such devices, and the present disclosure is adaptable and applicable to any punch block 10.

Figure 2:
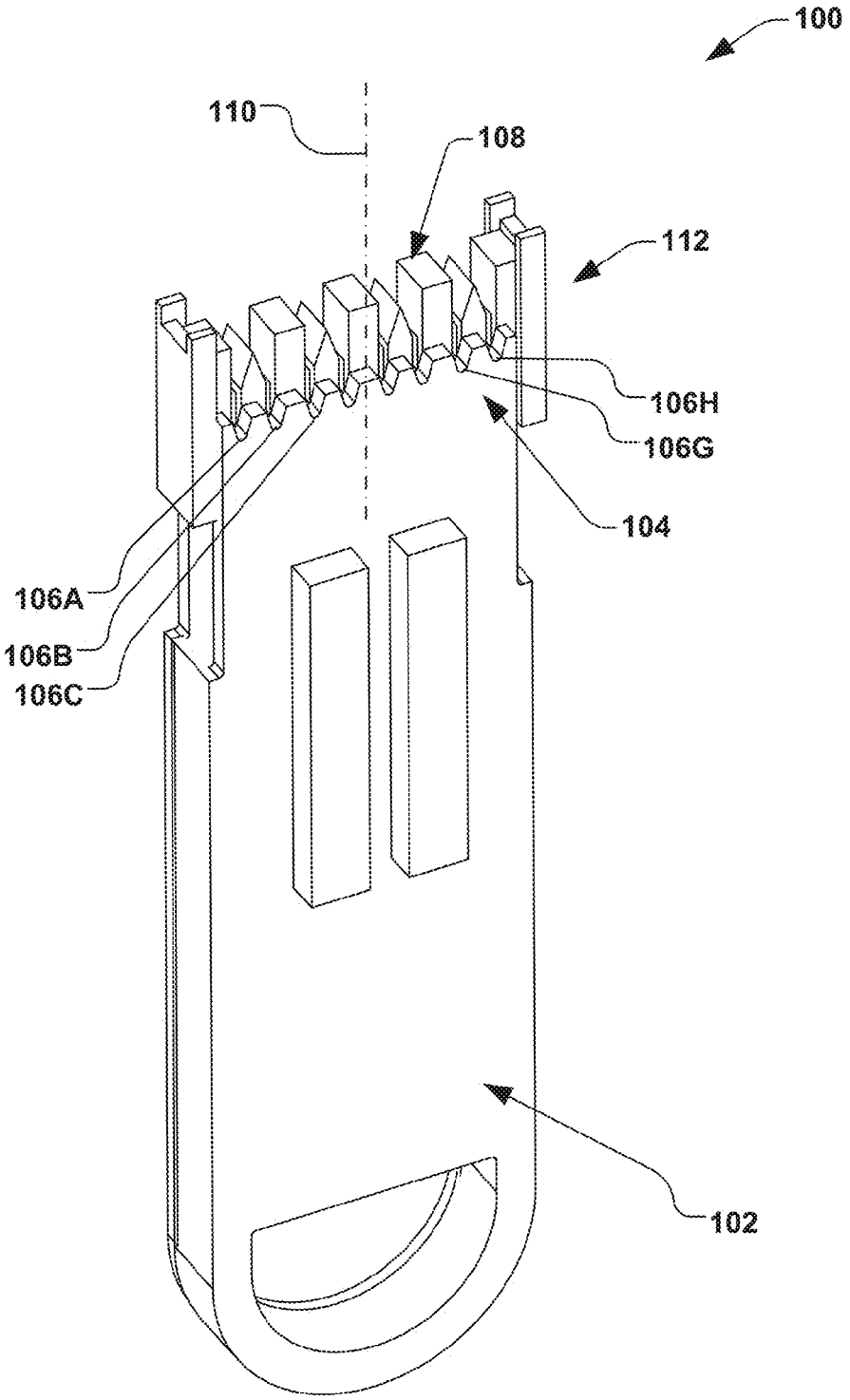
FIG. 2 illustrates a wire positioning tool according to one exemplary aspect of the present disclosure.

In accordance with the present disclosure, FIG. 2 illustrates an exemplary wire positioning tool 100 for positioning, but not seating, a plurality of individual wires in a terminal architecture or punch block, such as the punch block 10 of FIG. 1A. The wire positioning tool 100 of FIG. 2, for example, is thus configured to selectively concurrently place, but not electrically connect or "punch down", a plurality of individual wires in a plurality terminal contacts, as will be discussed in further detail infra. It should be noted that while the positioning tool 100 illustrated in FIG. 2 is configured to position eight wires, the present disclosure is not to be limited to any particular number of wires. In one particular example, the terminal architecture comprises a Cat-5 IDC 110-style terminal block 10 illustrated in FIG. 1, such as those often utilized in network telecommunications. The terminal block 10 of the present example thus comprises a plurality of sets of eight bifurcated terminal contacts or terminals 12 electrically isolated from one another by alternating insulative extensions 18 per block, as will be understood by one of ordinary skill in the art.

The wire positioning tool 100 will be further described with reference to various examples in FIGS. 2-12. In FIG. 2, for example, the wire positioning tool 100 is illustrated comprising a handle 102 and a positioning member 104 operably coupled thereto. The positioning member 104 in the present example is integral to the handle 102, wherein the handle is generally hollow. Alternatively, the positioning member 104 is an individual member that is fixedly coupled to the handle 102. In accordance with the present example, the positioning member 104 comprises a plurality of notches 106A-106H defined therein. The number of notches 106 in the positioning member 104, for example, can be varied for various positioning tools 100 in order to conform to a configuration of a particular terminal architecture and/or cable configuration.

A wire retention member 108 is retractably coupled to the handle 102, wherein the wire retention member is configured to slidingly translate along an axis 110 with respect to the positioning member 104. The wire retention member 108 is thus configured to linearly translate between a load position 112 illustrated in FIGS. 2, 5, 7, 9, and 12, and an unload position 114 illustrated in FIGS. 8 and 10, as will be described in further detail infra.

Figure 3:
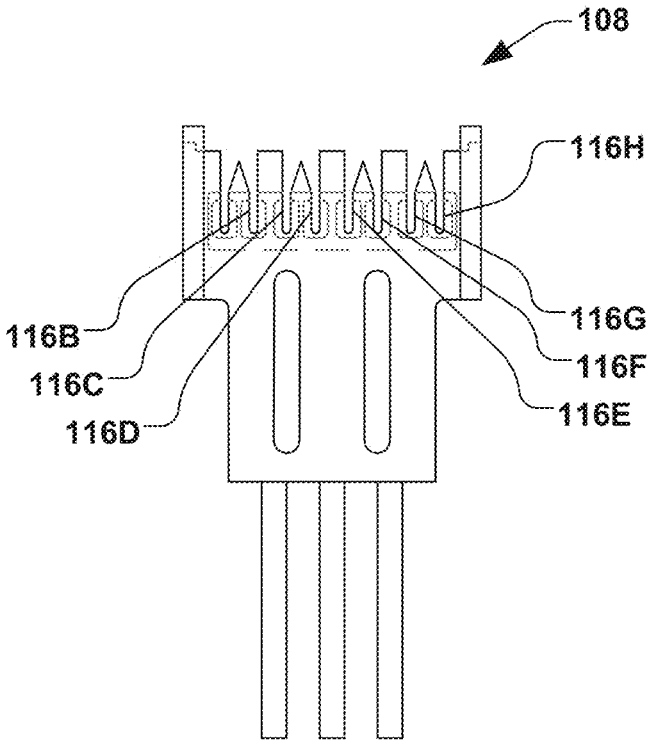
FIG. 3 illustrates a wire retention member according to another exemplary aspect of the disclosure.

One exemplary wire retention member 108 is illustrated in FIG. 3, wherein the wire retention member is shown to comprise a plurality of wire engagement slots 116A-116H, the number and configuration of which is associated with the plurality of notches 106A-106H of FIG. 2. In accordance with one example, the wire retention member 108 of FIG. 3 comprises one or more wire binding members 118 associated with each of the wire engagement slots 116A-116H, respectively, as illustrated in greater detail in FIG. 4. In one example, the wire binding member 118 associated with each wire engagement slot 116A-116H comprises one or more generally resilient members 120 associated with one or more sidewalls 122 of each respective wire engagement slot. The one or more wire binding members 118 associated with each wire engagement slot 116A-116H are configured to selectively secure a wire (e.g., the wire 16 of FIG. 1) in the respective wire engagement slot. The one or more generally resilient members 120, for example, comprise a rubber or other resilient material or compound positioned in a pocket 124 of the respective sidewall 122. Alternatively, the one or more generally resilient members 120 comprise one or more metallic or synthetic springs (not shown) associated with the respective sidewall 122. In accordance with yet another example, the one or more binding members 118 comprise a narrowing of a width 126 of the respective wire engagement slot 116A-116H, wherein the narrowed width selectively secures the respective wire via friction.

In accordance with another exemplary aspect of the disclosure, the wire retention member 108 comprises one or more location members 128 positioned at one or more ends 130 of the wire retention member, wherein the one or more location members are configured to mate with a location feature of the termination block. For example, the one or more location members 128 are configured to mate with one or more insulative extensions 18 of FIG. 1, therein providing the ability to properly position the wire retention member on the terminal block 10.

Figure 4:
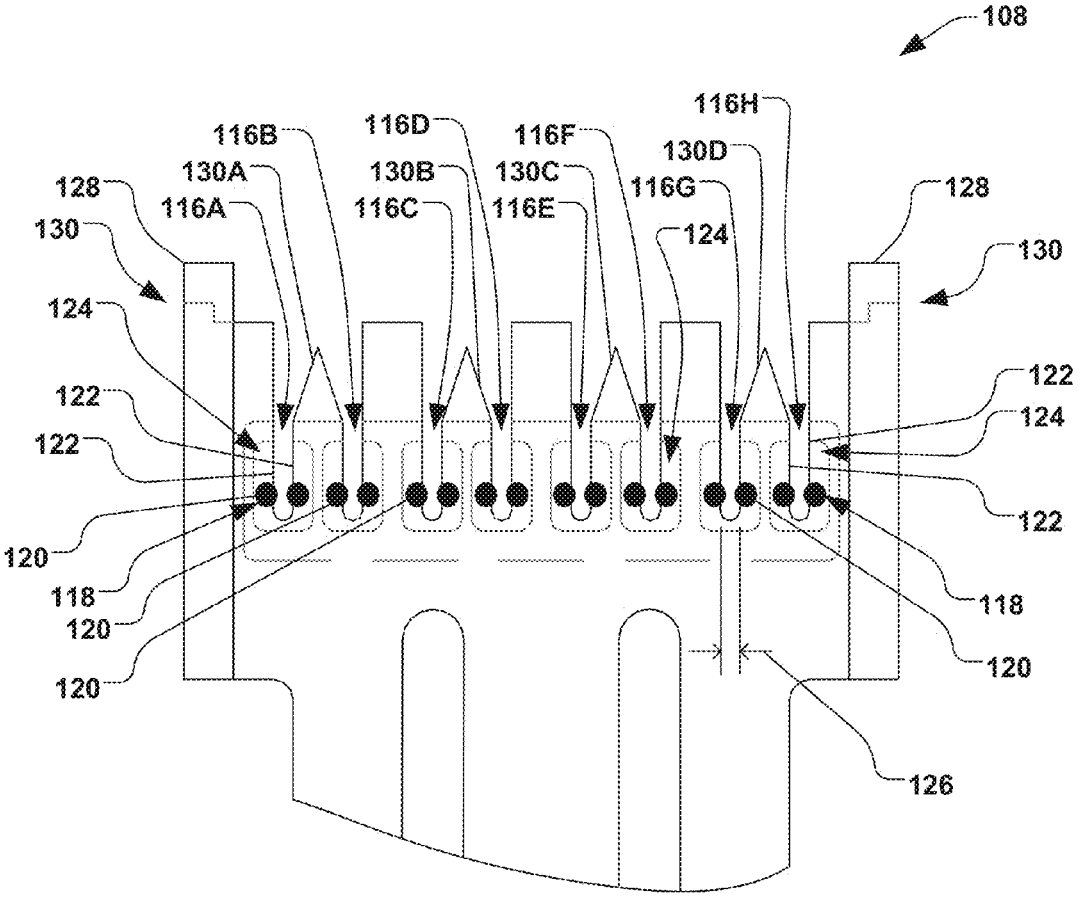
FIG. 4 illustrates an enlarged view of an exemplary wire retention member according to yet another exemplary aspect of the disclosure.

According to yet another exemplary aspect of the disclosure, the plurality of wire engagement slots 116A-116H of FIG. 4 are grouped in pairs, wherein the wire retention member 108 comprises a beveled alignment member 130 associated with each pair of wire engagement slots. As illustrated in greater detail in FIG. 5, each beveled alignment member 130, for example, is configured to guide a positioning or insertion of a wire 132 of a cable 136 into the respective wire engagement slots 116A-116H associated with the beveled alignment member. For example, beveled alignment member 130A is associated with wire engagement slots 116A and 116B, wherein the beveled alignment member 130A is configured to guide wires 132A and 132B (therein defining a first pair 134A of wires) into the wire engagement slots 116A and 116B. Beveled alignment member 130B is associated with wire engagement slots 116C and 116D, wherein the beveled alignment member 130B is configured to guide wires 132C and 132D (therein defining a second pair 134B of wires) into the wire engagement slots 116C and 116D, and so on. A separating member 138, for example, is further disposed between each beveled alignment member 130, therein differentiating each pair of wire engagement slots 116, and each pair 134A-134D of wires 132A-132H.

Figure 5:
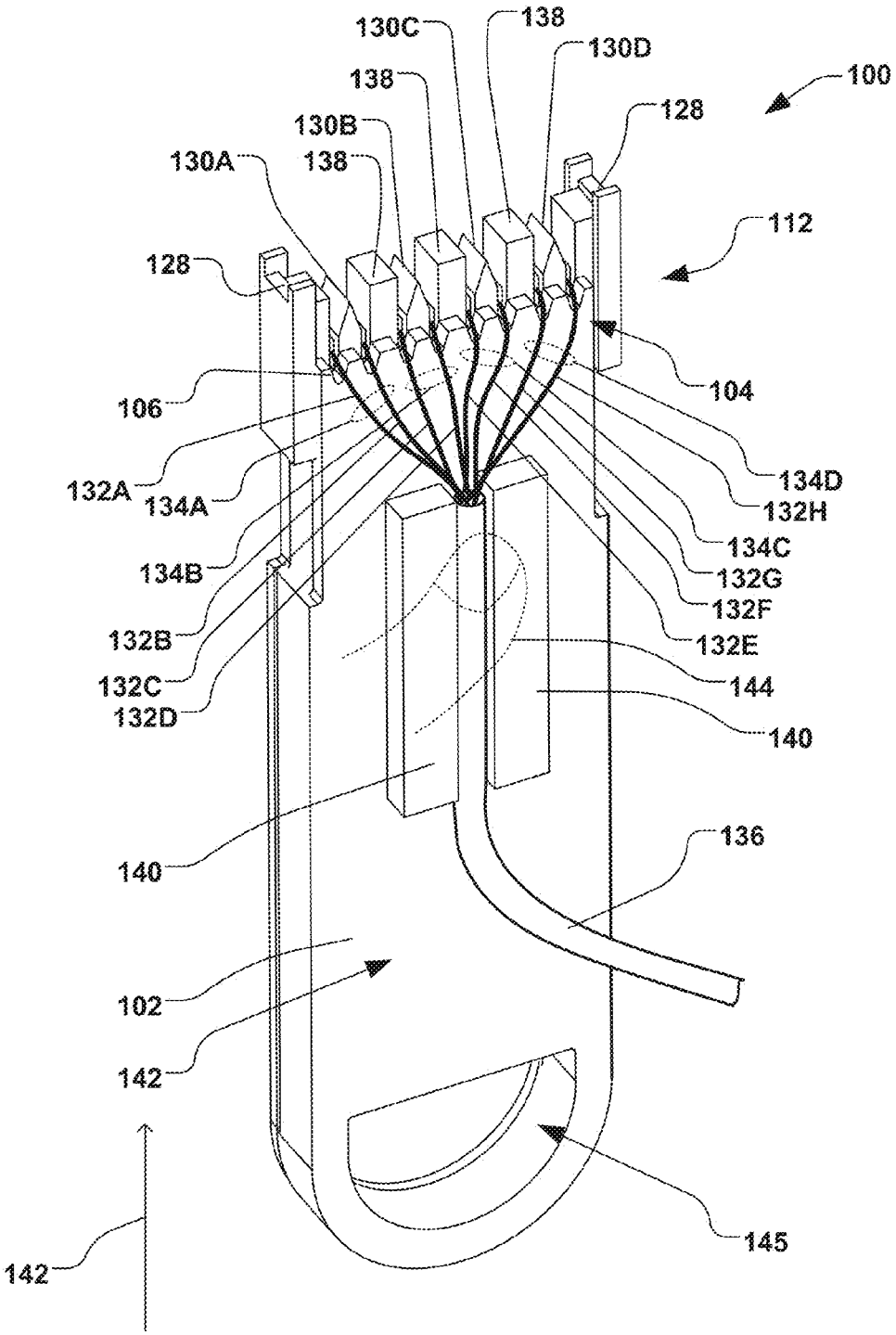
FIG. 5 illustrates a wire positioning tool holding a plurality of twisted pair wires of a cable according to another exemplary aspect of the present disclosure.

Another exemplary aspect is further illustrated in FIG. 5, wherein the handle 102 comprises one or more cable guidance members 140 extending along a length of an outer portion 142 of the handle 102. The one or more cable guidance members 140, for example, comprise one or more of grooves, blocks, raised or recessed surfaces, or other mechanical features defined in or coupled to the outer portion 142 of the handle. The one or more cable guidance members 140, for example, provide for a stabilization and/or holding of the cable 136 buy an installer 144, as will be discussed further hereafter. The one or more cable guidance members 140, for example, further limit a deleterious untwisting of the plurality of pairs 134 of wires 132 beyond a predetermined length. Extensive untwisting of the pairs 134 of wires 132 can have negative implications to signal strength provided by the respective pairs of wires.

Figure 6:
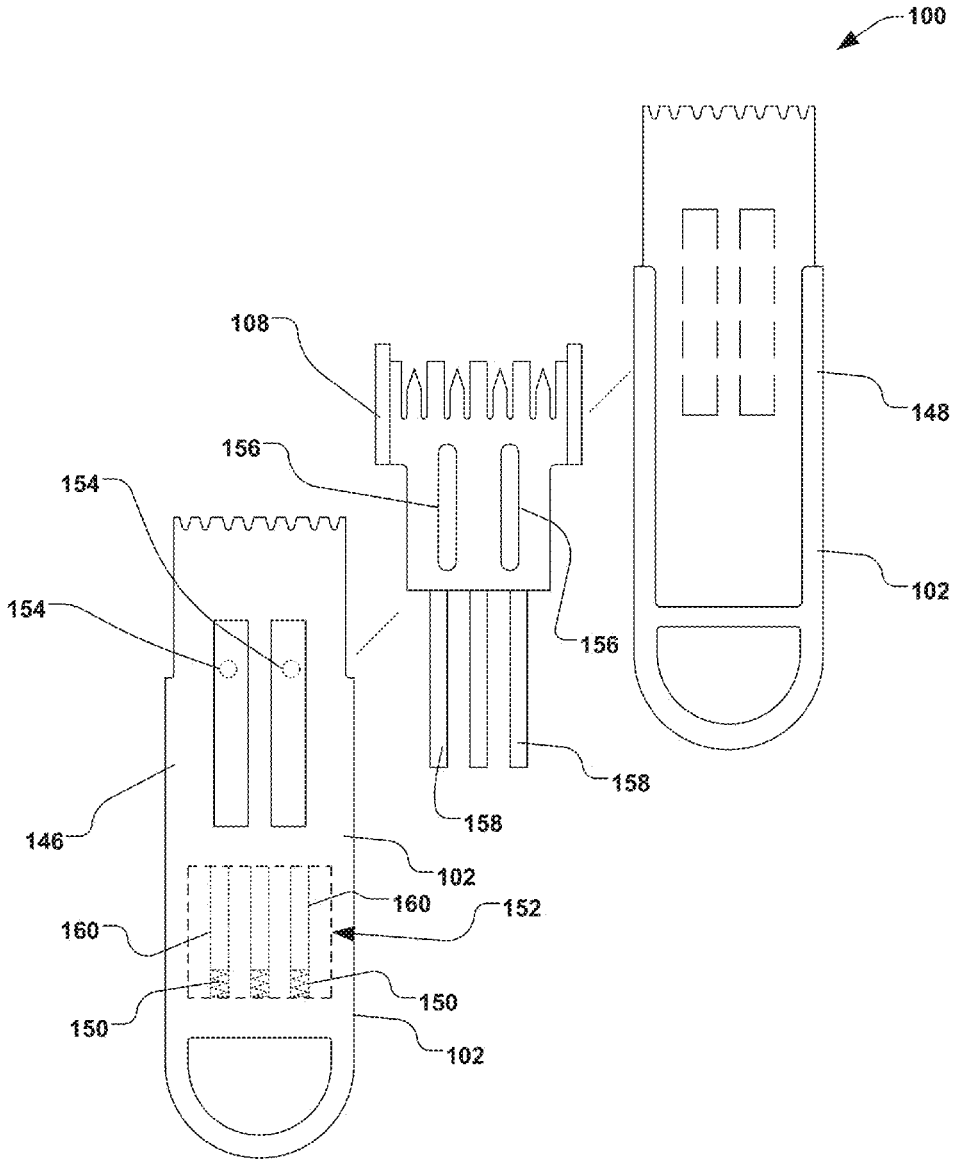
FIG. 6 illustrates an exploded plan view of an exemplary wire positioning tool in accordance with a further aspect of the disclosure.

According to another example, the handle 102 comprises an opening 145, wherein the opening is configured to aid the installer 144 during handling of the tool 100. For example, the opening 145 is configured as a finger or thumb hold, such that the installer is provided additional leverage or maneuverability in tight spaces. The opening 145 alternatively serves as a securement region, such that the installer can releasably attach the tool 100 to an object, such as a tool belt, cable, or other object for stowage. In accordance with another exemplary aspect, the handle 102 comprises a first portion 146 and a second portion 148, as illustrated in the in the exploded view of FIG. 6, wherein the tool 100 is formed by sandwiching the wire retention member 108 between the first portion and second portion of the handle. The first portion 146 and the second portion 148 of the handle 102, for example, are fixedly or removably coupled to one another by glue, screws, thermal bonding, mating fasteners molded into the first and/or second portion, or any other fastening mechanism, as will be appreciated by one of ordinary skill in the art. As illustrated in FIG. 6, the plurality of notches 106 of the positioning member 104 are disposed on opposing sides of the wire retention member 108, wherein the first portion 146 and second portion 148 of the handle 102 are joined to define the positioning member.

Figure 7:
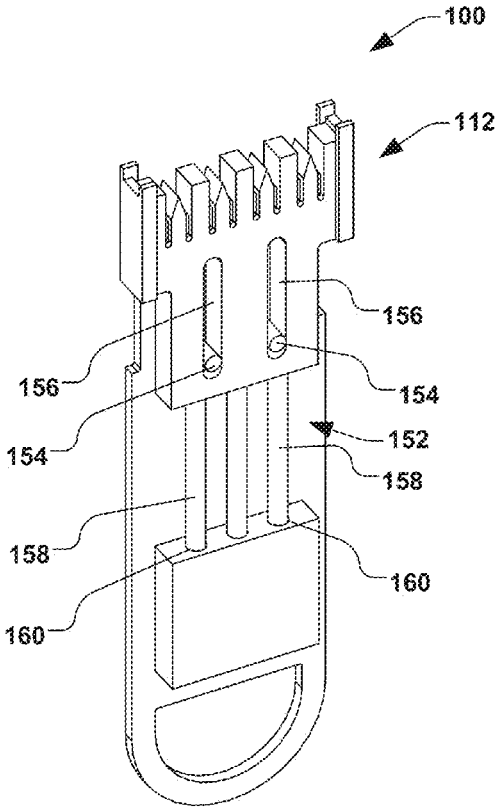
FIG. 7 is a partial cross-section of a wire positioning tool in a load position in accordance with an exemplary aspect of the disclosure.
Figure 8:
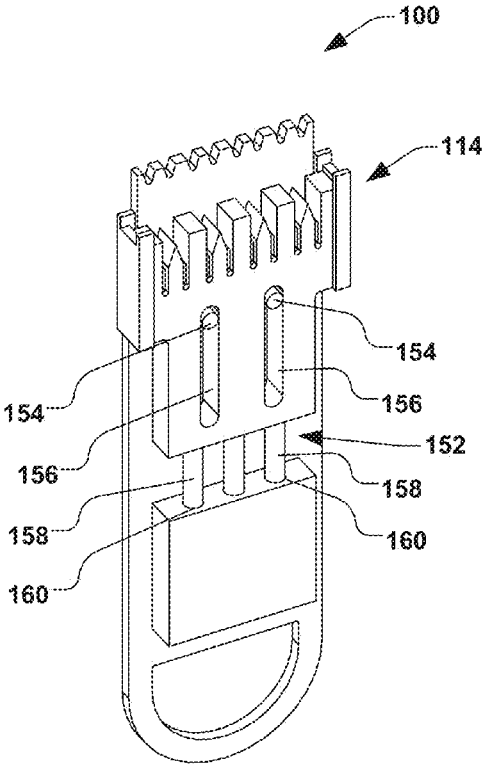
FIG. 8 is a partial cross-section of a wire positioning tool in an unload position in accordance with another exemplary aspect of the disclosure.

According to another example of the present disclosure, the wire retention member 108 is further biased toward the load position 112 of FIGS. 2, 5, 7, 9, and 12 by one or more springs 150 associated with a translation assembly 152, as illustrated in FIGS. 6-8. The translation assembly 152, as illustrated in FIG. 7, for example, generally maintains a linear non-rotating motion of the wire retention member 108 with respect to the handle 102 by one or more of pins 154, slots 156, rods 158, holes 160, or other linear sliding surfaces associated with one or more of the wire retention member and the handle. The quantity of such pins 154, slots 156, rods 158, holes 160 or other features limiting the translation of the retention member is customizable based on the desired manufacturing method and/or materials used in the construction of the tool 100.

Figure 9:
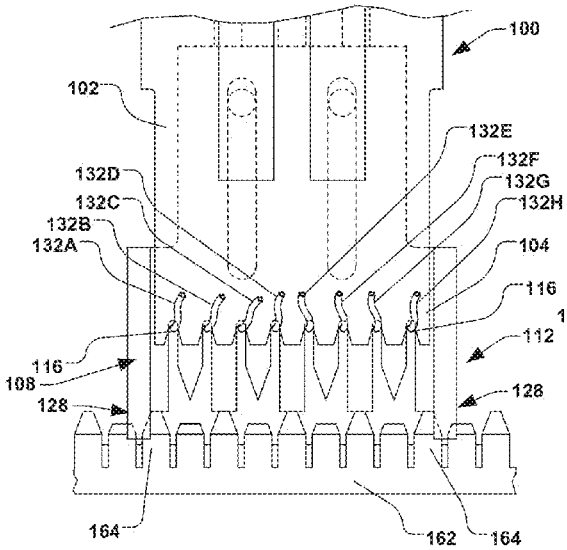
FIG. 9 illustrates a wire positioning tool placed on a termination block according to still another exemplary aspect of the disclosure.

In accordance with another aspect of the present disclosure, when the wire retention member 108 is in the load position 112, as again illustrated in FIG. 5, the wire retention member is configured to selectively secure each of the plurality of wires 132A-132H thereto in the respective wire engagement slots 116, as again shown in FIG. 4. When the plurality of wires 132 are secured in the respective plurality of wire engagement slots 116, the tool 100 is placed into position on a termination block 162, as illustrated in FIG. 9, wherein the one or more location members 128 are configured to mate with the one or more insulative extensions 164 for accurate placement of the tool, even when the termination block is not in the line of sight of the installer.

Figure 10:
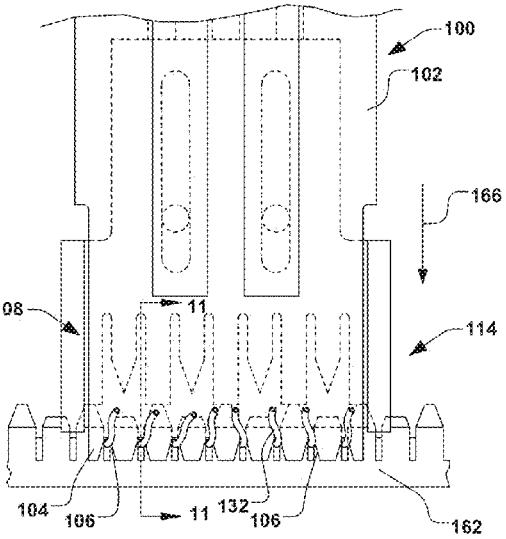
FIG. 10 illustrates the wire positioning tool of FIG. 9 placing a plurality of wires on a termination block according to another exemplary aspect of the disclosure.
Figure 11:
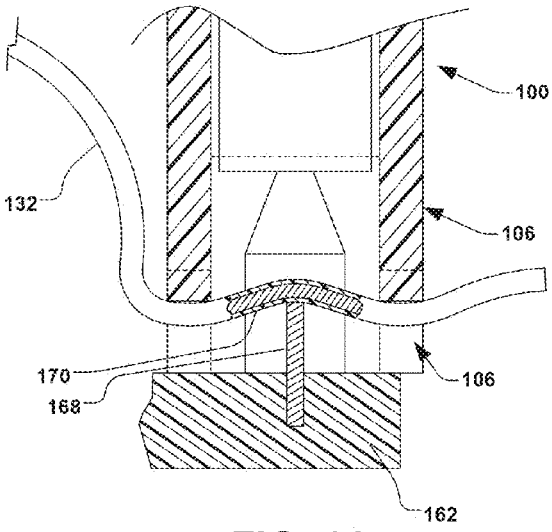
FIG. 11 illustrates a cross section of the wire positioning tool of FIG. 10 placing a plurality of wires on the termination block.

Once placed in the appropriate position on the termination block 116, the wire retention member 108 is retracted with respect to the positioning member 104, as illustrated in FIG. 10, by pushing the handle 102 in the direction 166 toward the termination block 162, therein transferring the plurality of wires 132 from the wire retention member onto the plurality of terminals, as illustrated in greater detail in FIG. 11. The plurality of notches 106 in the positioning member 104 thus place the plurality of wires 132 onto the plurality of terminals 168. It is noted that the tool 100 of the present disclosure advantageously places the wires 132 onto the plurality of terminals prior to seating the wires in the terminals 168 (e.g., piercing the insulation 170 of the wires and/or cutting the wires).

Figure 12:
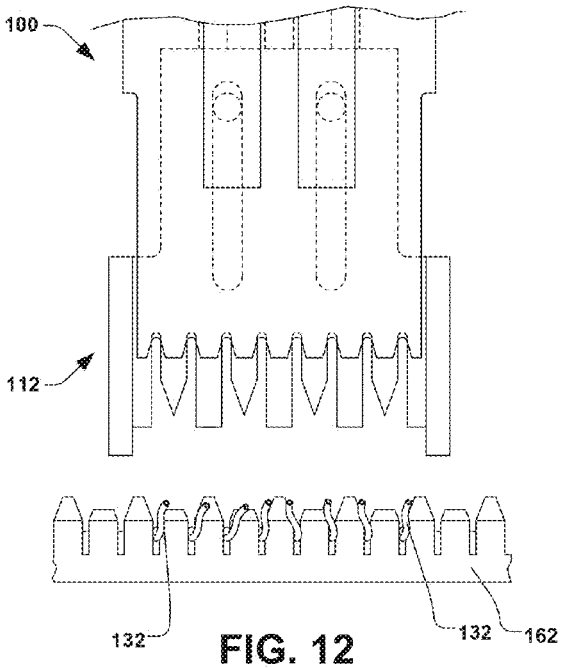
FIG. 12 illustrates the wire positioning tool of FIGS. 9-11 after placing a plurality of wires on a termination block according to another exemplary aspect of the disclosure.
Figure 13A:
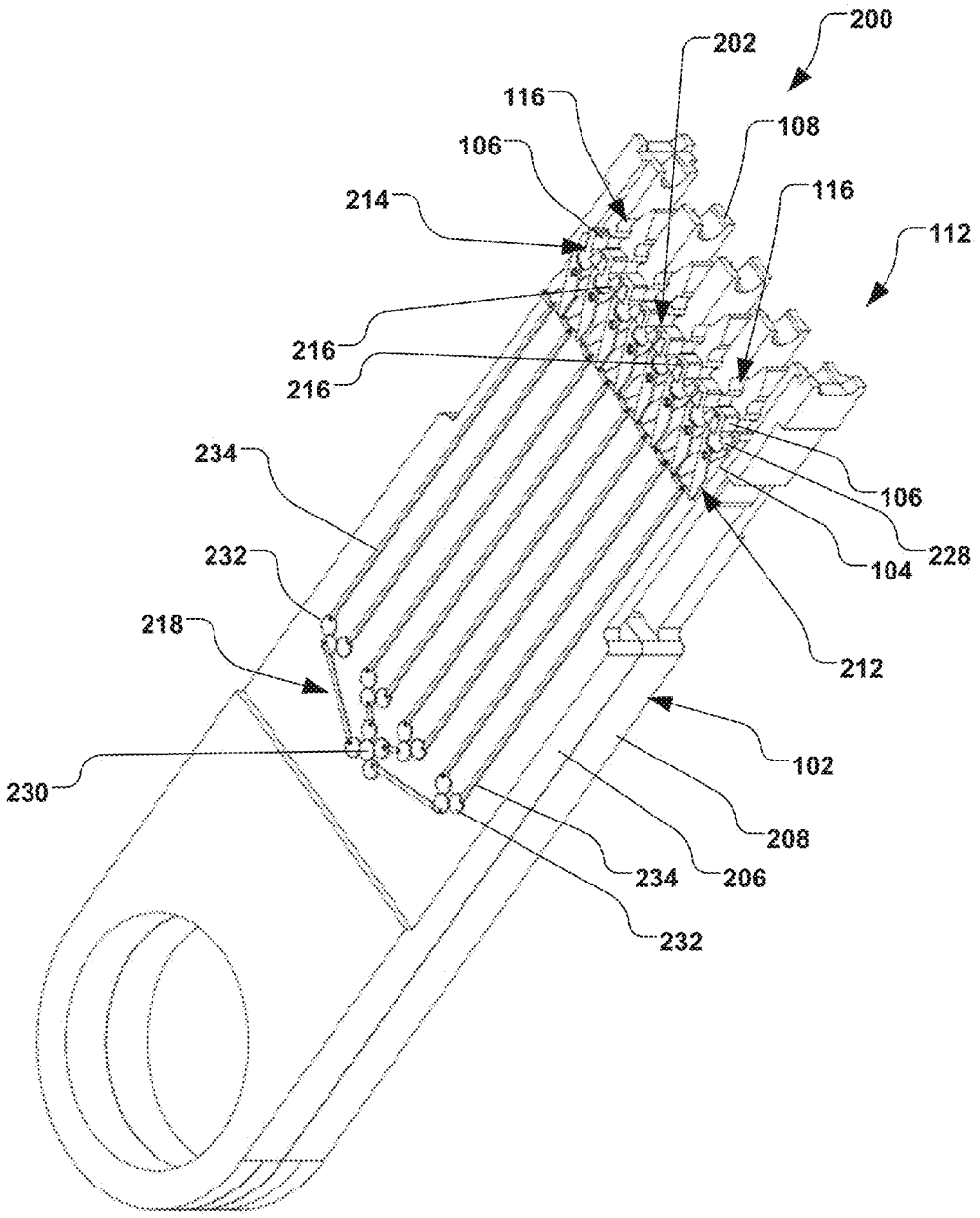
FIG. 13A-13B illustrate perspective views of an exemplary wire terminating tool comprising a seating apparatus and cutting apparatus in respective load and unload positions.
Figure 13B:
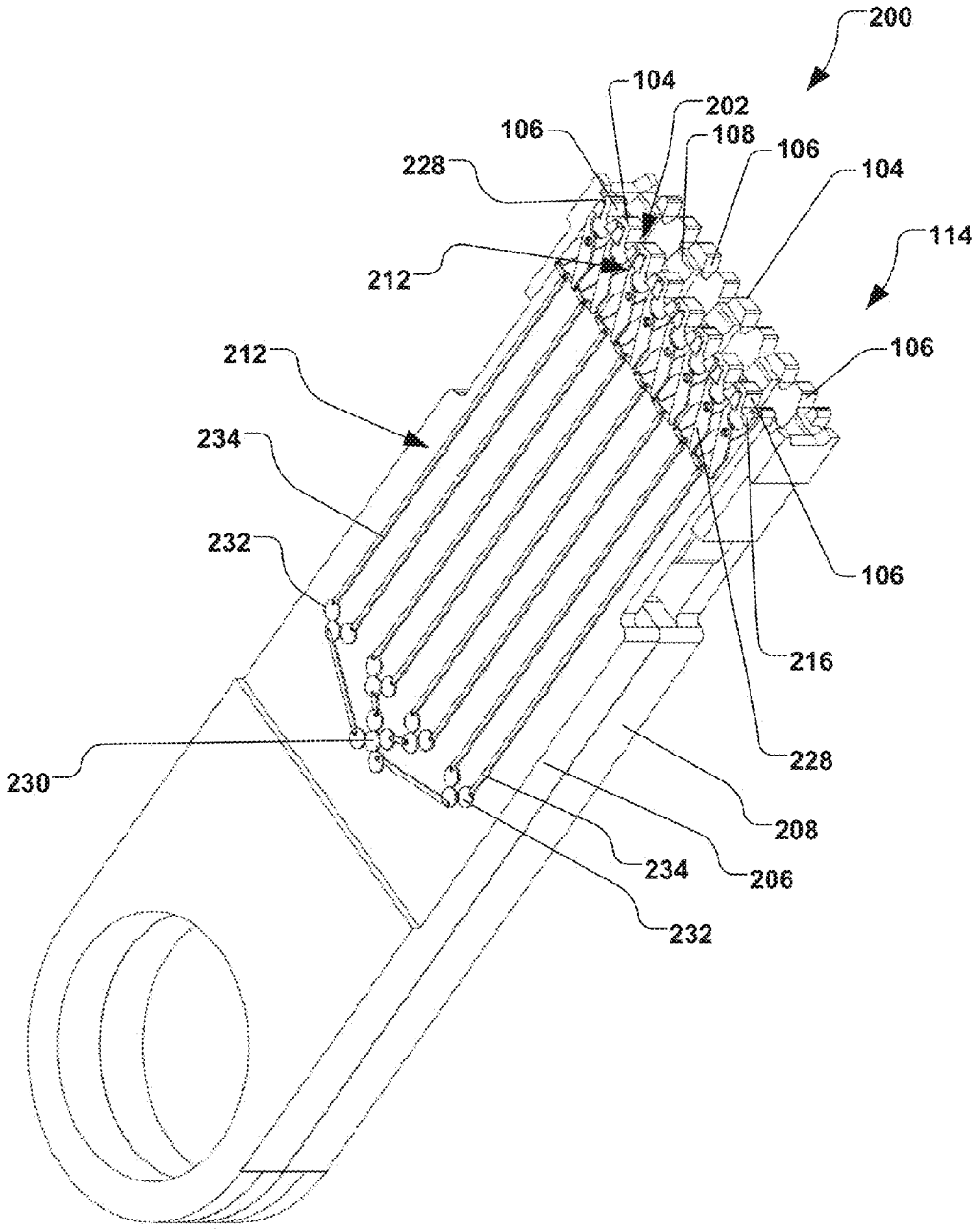
Figure 14A:
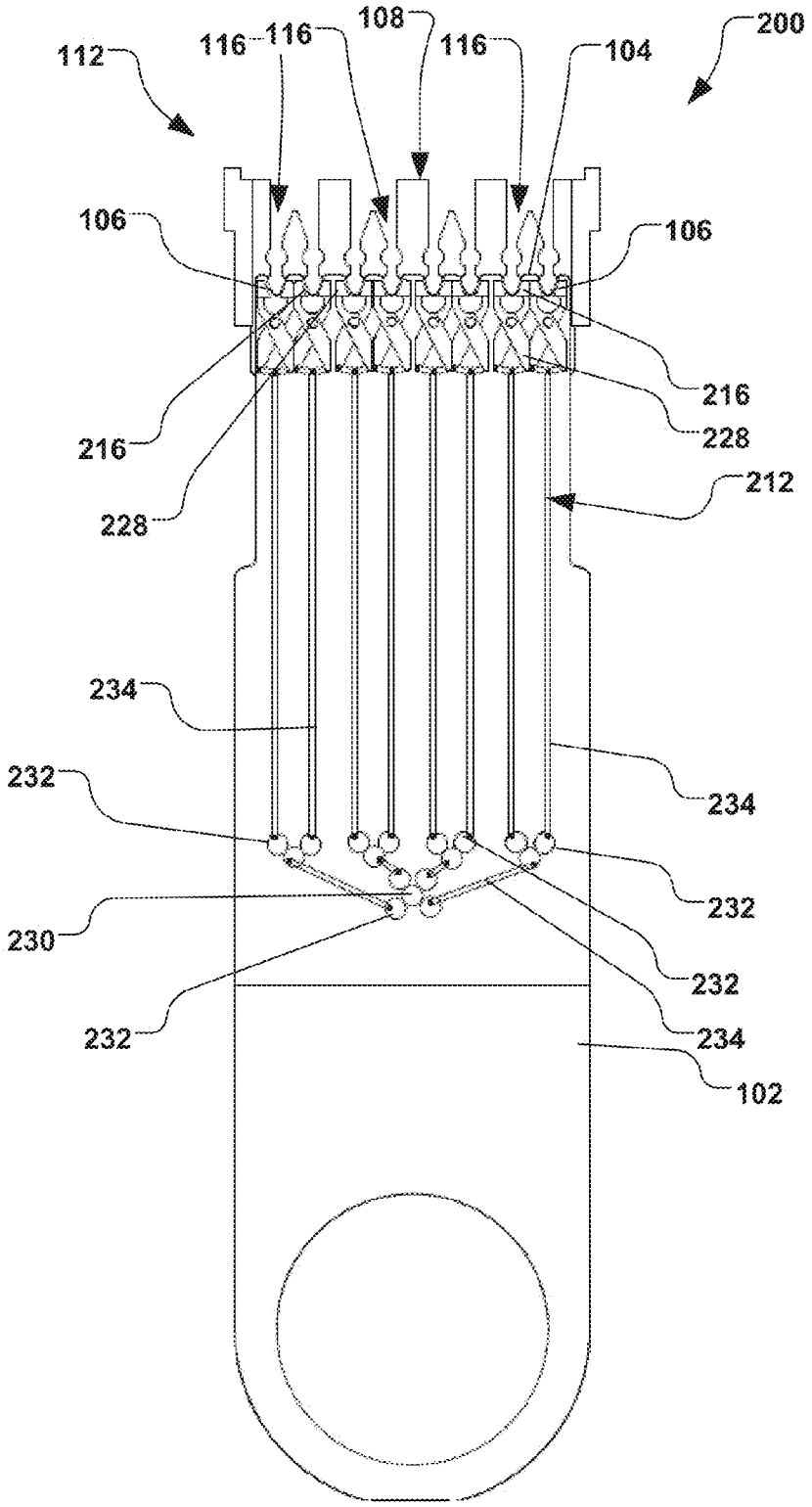
FIGS. 14A-14B illustrate plan views of an wire terminating tool in respective load and unload positions according to an example.
Figure 14B:
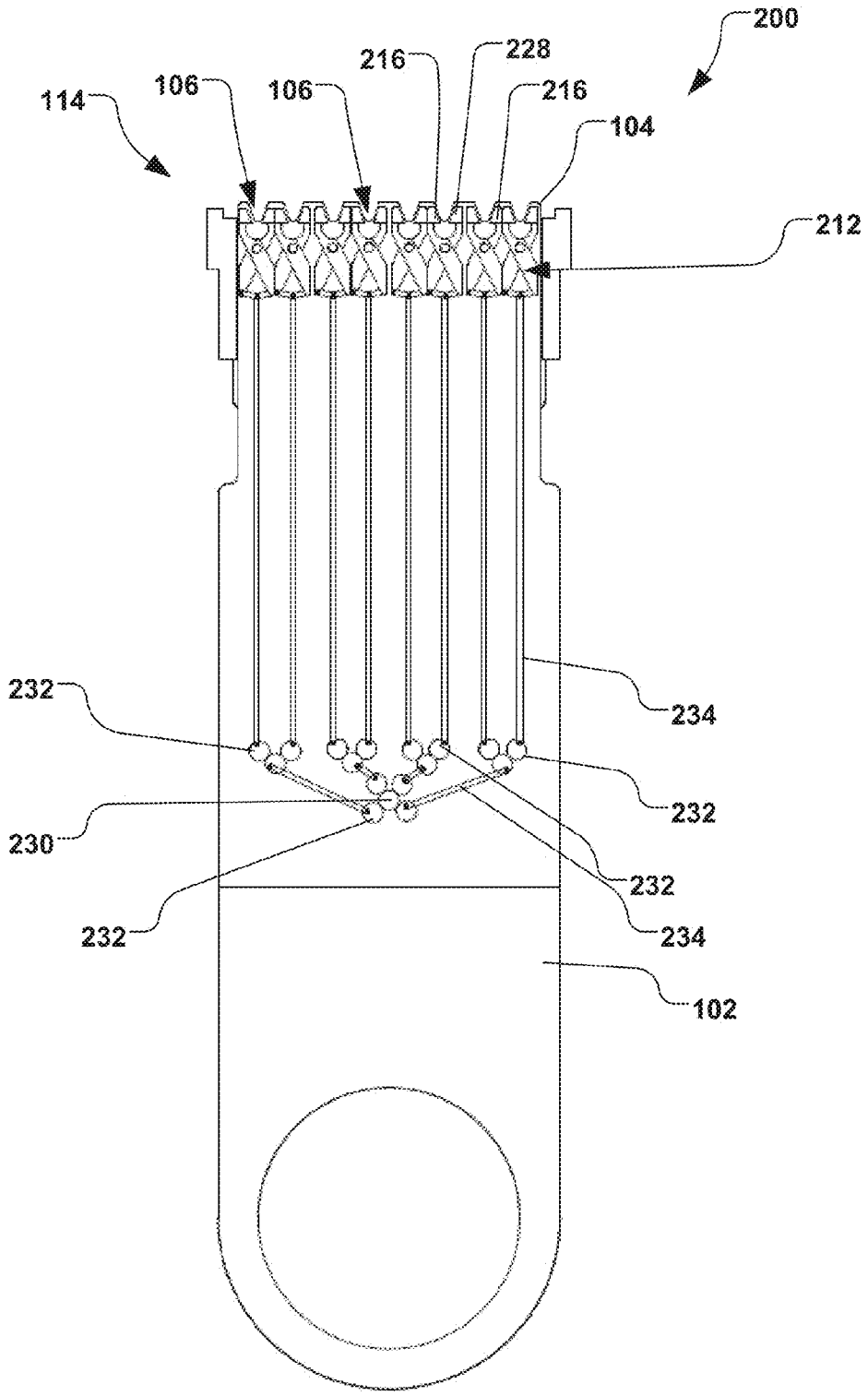
Figure 15:
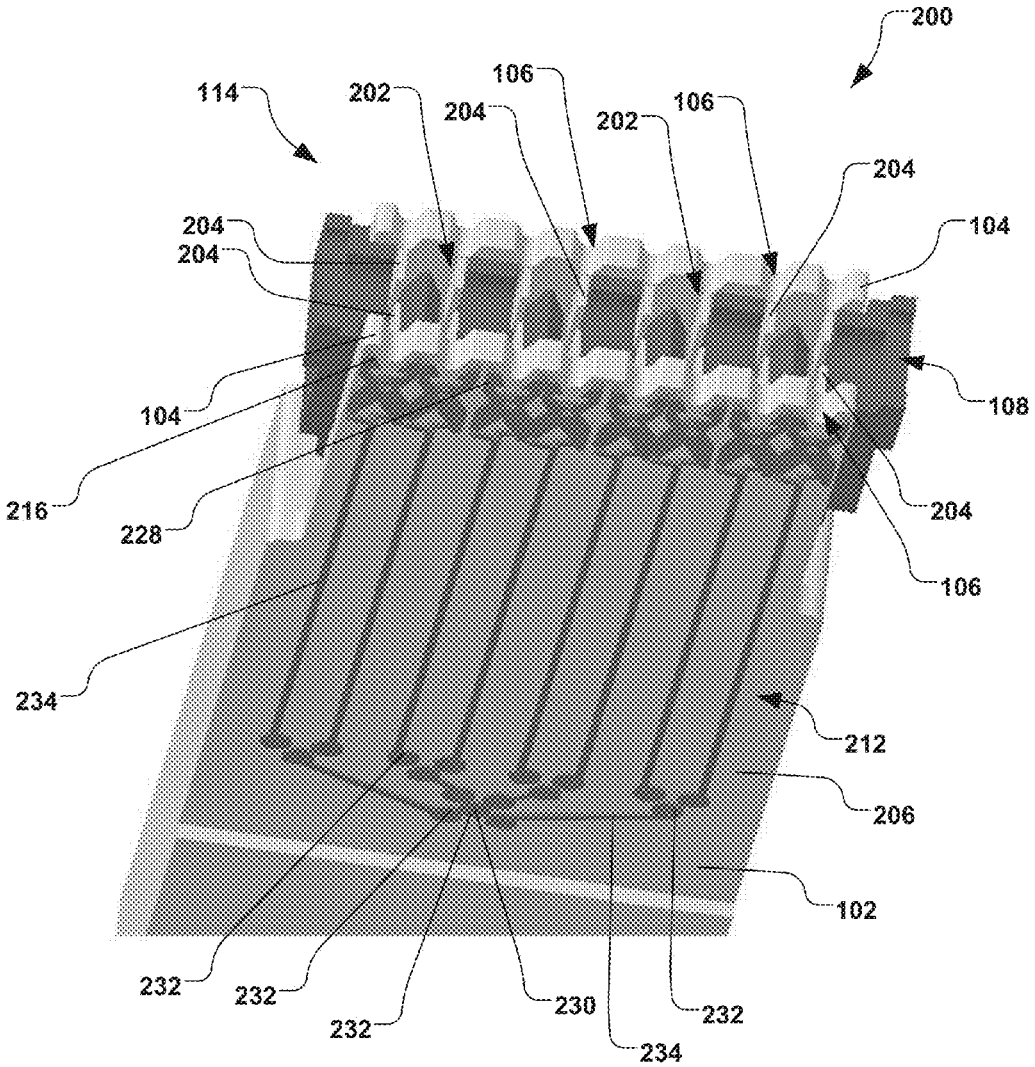
FIG. 15 illustrates partial perspective view of a wire terminating tool comprising a seating apparatus and cutting apparatus according to another example.

Referring now to FIGS. 13-15, a wire terminating tool 200 is illustrated in accordance with another aspect of the disclosure. The wire positioning tool 100 and corresponding components of FIGS. 2-12, for example, are further provided in the wire terminating tool 200 of FIGS. 13-15. FIGS. 13A, 14A, for example, illustrate the wire terminating tool 200 in the load position 112, and FIGS. 13B, 14B, and 15 illustrate the wire terminating tool in the unload position 114.

Figure 16:
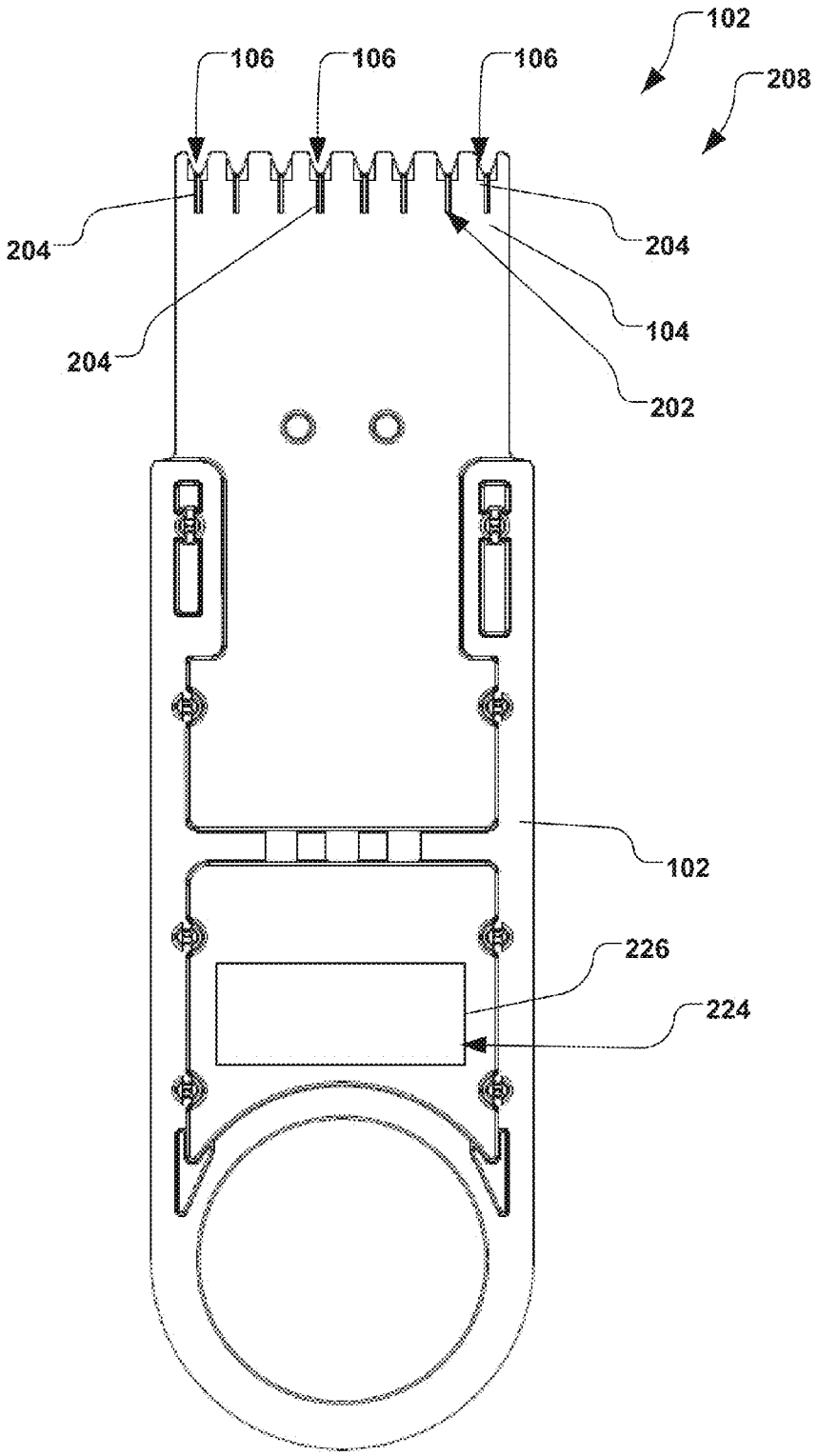
FIG. 16 illustrates a plan view of portion of a handle of a wire terminating tool comprising a seating apparatus according to still another example.
Figure 17:
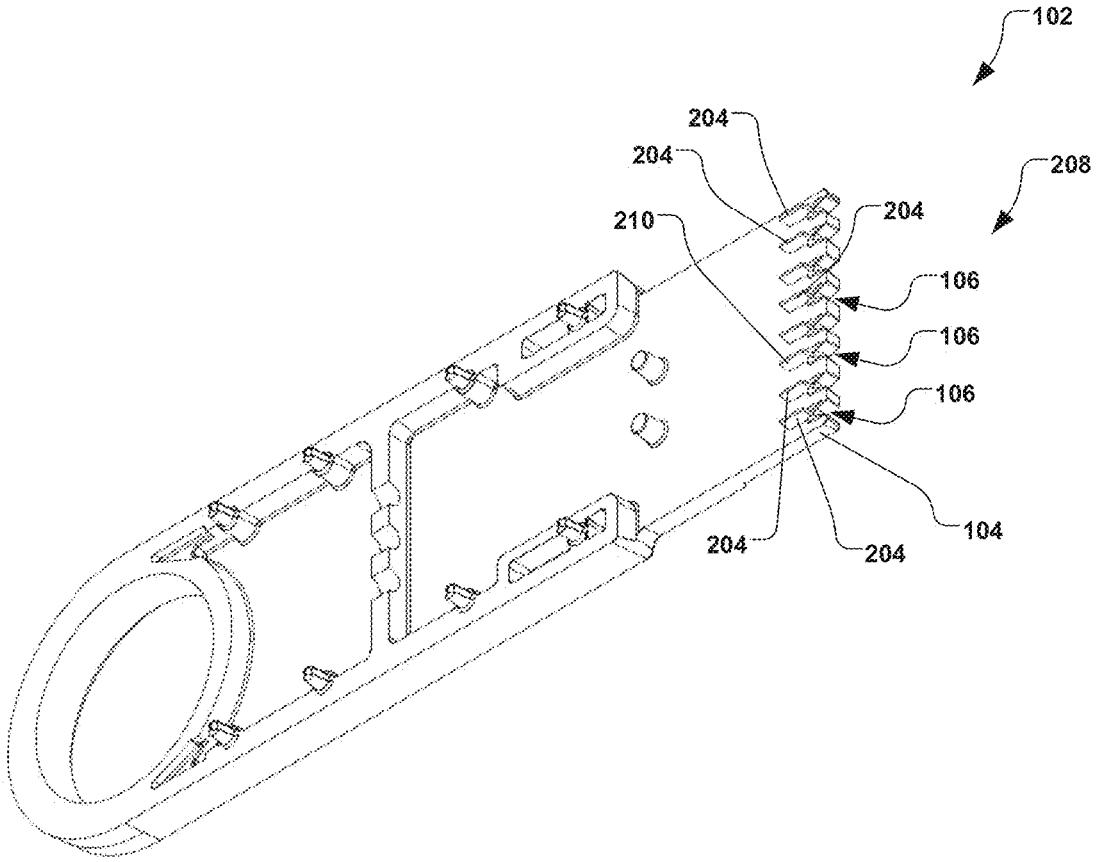
FIG. 17 illustrates a perspective view of a handle of a wire terminating tool comprising a seating apparatus according to yet another example.
Figure 18:
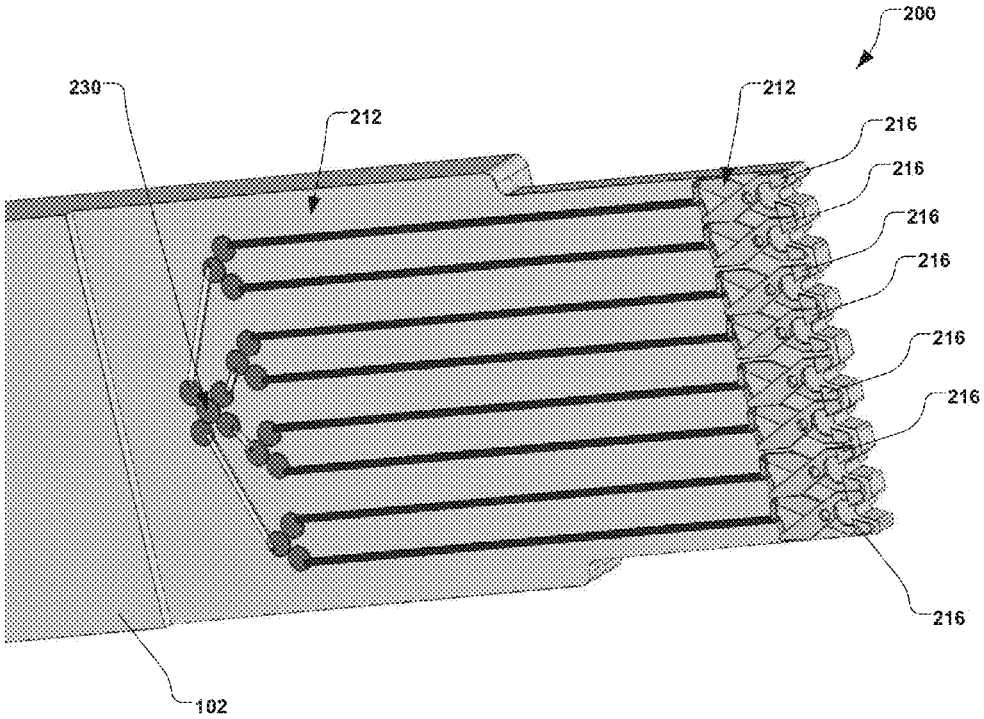
FIG. 18 illustrates a perspective view of portion of a wire terminating tool comprising a cutting apparatus according to a further example.

In accordance with one example, the wire terminating tool 200 of FIGS. 13-15 comprise a seating apparatus 202 illustrated in greater detail in FIGS. 15-17. The seating apparatus 202, for example, is configured to seat the plurality of wires 132 of FIG. 11 in the plurality of terminals 168, respectively, therein providing a metal-to-metal contact between the respective plurality of wires and plurality of terminals, as illustrated in FIG. 12. The seating apparatus 202 illustrated in FIGS. 15-17, for example, comprises a seating member 204 respectively associated with each of the plurality of notches 106, wherein each seating member is operably coupled to the positioning member 104 and configured to seat a respective one of the plurality of wires 132 of FIG. 11 in the respective terminal 168 concurrent with the retraction of the wire retention member 108 with respect to the positioning member.

The handle 102 illustrated in FIGS. 13A-13B, for example, comprises a first portion 206 and a second portion 208, wherein the first portion and second portion generally retain the wire retention member 108 in sliding engagement thereto, as discussed above. The seating apparatus 202, for example, is operably coupled to one or more of the first portion 206 and second portion 208 of the handle. In another example, each seating member 204 comprises one or more of a pin, bar, plate, and extrusion fixedly coupled to one or more of the first portion 206 and second portion 208 of the handle (e.g., plates 210 illustrated in the second portion of the handle in FIG. 17). In the present example, the seating members 204 extend inwardly toward the wire retention member 108. The seating members 204, for example, are comprised of a material that is sufficiently hard and durable to withstand repeated contact with the wires 132 and terminal 168, such as a metal, ceramic, hard plastic, or other material.

In accordance with another exemplary aspect of the disclosure, as illustrated in FIGS. 13-14 and 17, the wire terminating tool 200 further comprises a cutting apparatus 212 operably coupled to the handle 102 and configured to cut the plurality wires 132 of FIG. 10. For example, the cutting apparatus 212 is configured to cut the plurality of wires at a predetermined position 214 proximate to the positioning member 104, as illustrated in FIG. 13A. It should be noted that a cover, although not shown, can be further provided to protect at least a portion of the cutting apparatus 212.

The cutting apparatus 212, for example, comprises a cutter 216 respectively associated with each of the plurality of notches 106, wherein each cutter is operably coupled to the positioning member 104 and configured to cut a respective one of the plurality of wires 132 of FIG. 10 subsequent to the retraction of the wire retention member 108 with respect to the positioning member (e.g., when the wire retention member is in the unload position 114 illustrated in FIGS. 13B, 14B, and 15). The cutting apparatus 212, for example, is operably coupled to one of the first portion 206 and second portion 208 of the handle 102. As illustrated in the examples of FIGS. 13-15 and 17, the cutting apparatus 212 is operably coupled to the first portion 206 of the handle 102, but could alternatively be coupled to the second portion 208 illustrated in FIGS. 13-14.

In accordance with another example, each cutter 216 comprises one or more of a roller cutter, diagonal cutter, blade, and shear operably coupled to the one of the first portion 206 and second portion 208 of the handle 102. In one example, the cutting apparatus 212 comprises an activator 218 operably coupled to each cutter 216, as illustrated in FIG. 13A, wherein the activator is configured to translate each cutter with respect to the positioning member 104, therein cutting each respective wire 132 of FIG. 10. The activator 218, for example, comprises one or more of a motor (not shown), gears 220, and linkages 222 operably coupled to each cutter 216. A power source 224, such as a battery 226 removably positioned within the handle 102 of FIG. 16, for example, is operably coupled to the activator 218 for actuation thereof.

In the non-limiting examples illustrated in FIGS. 13-17, each cutter 216 comprises one or more shears 228, and wherein the cutting apparatus 212 further comprises a trigger mechanism (e.g., an electrical switch or trigger coupled to the handle 102) for selective actuation of the activator 218. The activator 218, for example, comprises a motor (not shown) having a shaft 230 operably coupled to each of the one or more shears 228 via a plurality of gears 232 and linkages 234. The trigger mechanism selectively actuates the motor, thus causing a rotation of the shaft 230 and associated gears 232, wherein the linkages 234, being eccentrically coupled to the gears, pivots each of the one or more shears 228 about a respective axis 236 via kinematics. Thus, the rotation of the shaft 230 via the motor cuts each respective wire 132 of FIG. 10 by slicing or crimping action of the one or more shears 228.

It should be noted that the motor and kinematic gear/linkage arrangement described above is but one example of various ways of cutting the wires, and that other mechanisms are also contemplated as falling within the scope of the present disclosure. For example, various arrangements of roller cutters, shears, diagonal cutters, blades, or other apparatus used in cutting wires are also contemplated. In another alternative, a lever mechanism (not shown) is operably coupled to the handle 102, wherein the lever mechanism is manually actuated by a user, and wherein a lever actuates the above-mentioned cutting apparatus 212. The lever mechanism, for example, is provided within or in association with, the handle, wherein the lever mechanism amplifies the induced force on the lever, therein more readily cutting the plurality of wires. Further, other seating apparatus 202 and cutting apparatus 212 are also contemplated, including spring-loaded actuators, or various other seating and cutting mechanisms, and all such mechanisms are contemplated as falling within the scope of the present disclosure.

It should be noted that while exemplary methods are illustrated and/or described herein as a series of acts or events, it will be appreciated that the present invention is not limited by the illustrated ordering of such acts or events, as some steps may occur in different orders and/or concurrently with other steps apart from that shown and described herein, in accordance with the invention. In addition, not all illustrated steps may be required to implement a methodology in accordance with the present invention. Moreover, it will be appreciated that the methods may be implemented in association with the systems illustrated and described herein as well as in association with other systems not illustrated.

Although the disclosure has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the disclosure. In addition, while a particular feature of the disclosure may have been disclosed with respect to only one of several embodiments, such feature may be combined with one or more other features of the other embodiments as may be desired and advantageous for any given or particular application.

What is claimed is:

1. A wire terminating tool for positioning and terminating a plurality of wires in a termination block, the wire terminating tool comprising:

a handle;

a positioning member operably coupled to the handle, wherein the positioning member comprises a plurality of notches;

a wire retention member retractably coupled to the handle and configured to slidingly translate with respect to the positioning member between a load position and an unload position, wherein the wire retention member comprises a plurality of wire engagement slots, and wherein in the load position, the wire retention member is configured to selectively secure each of the plurality of wires thereto in a respective one of the plurality of wire engagement slots, and wherein in the unload position, the wire retention member is retracted with respect to the positioning member, therein transferring the plurality of wires from the wire retention member to the plurality of notches in the positioning member, and wherein the positioning member is configured to position each of the plurality of wires in a respective terminal of the termination block; and a seating apparatus configured to seat the plurality of wires in the plurality of terminals, respectively, therein providing a metal-to-metal contact between the respective plurality of wires and plurality of terminals.

2. The wire terminating tool of claim 1, wherein the seating apparatus comprises a seating member respectively associated with each of the plurality of notches, wherein each seating member is operably coupled to the positioning member and configured to seat a respective one of the plurality of wires in the respective terminal concurrent with the retraction of the wire retention member with respect to the positioning member.

3. The wire terminating tool of claim 2, wherein the handle comprises a first portion and a second portion, wherein the first portion and second portion generally retain the wire retention member in sliding engagement thereto, and wherein the seating apparatus is operably coupled to one or more of the first portion and second portion of the handle.

4. The wire terminating tool of claim 3, wherein each seating member comprises one or more of a pin, bar, plate, and extrusion fixedly coupled to one or more of the first portion and second portion of the handle.

5. The wire terminating tool of claim 2, wherein each seating member comprises one or more of a pin, bar and extrusion operably coupled to the positioning member and extending inwardly toward the wire retention member.

6. The wire terminating tool of claim 1, further comprising a cutting apparatus operably coupled to the handle and configured to cut the plurality wires at a predetermined position.

7. The wire terminating tool of claim 6, wherein the cutting apparatus comprises a cutter respectively associated with each of the plurality of notches, wherein each cutter is operably coupled to the positioning member and configured to cut a respective one of the plurality of wires subsequent to the retraction of the wire retention member with respect to the positioning member.

8. The wire terminating tool of claim 7, wherein the handle comprises a first portion and a second portion, wherein the first portion and second portion generally retain the wire retention member in sliding engagement thereto, and wherein the cutting apparatus is operably coupled to one of the first portion and second portion of the handle.

9. The wire terminating tool of claim 8, wherein each cutter comprises one or more of a roller cutter, diagonal cutter, blade, and shear operably coupled to the one of the first portion and second portion of the handle.

10. The wire terminating tool of claim 9, wherein the cutting apparatus comprises an activator operably coupled to each cutter, wherein the activator is configured to translate each cutter with respect to the positioning member, therein cutting each respective wire.

11. The wire terminating tool of claim 10, wherein the activator comprises one or more of a motor, gears, and linkages operably coupled to each cutter.

12. The wire terminating tool of claim 11, further comprising a power source operably coupled to the activator.

13. The wire terminating tool of claim 12, wherein the power source comprises a battery removably positioned within the handle.

14. The wire terminating tool of claim 10, wherein the activator comprises a lever operably coupled to the handle, wherein the lever is manually actuated by a user.

15. The wire terminating tool of claim 7, wherein each cutter comprises one or more shears, and wherein the cutting apparatus further comprises a trigger mechanism and a motor having a shaft operably coupled to each of the one or more shears via a plurality of gears and linkages, wherein the trigger mechanism selectively actuates the motor causing a rotation of the shaft, wherein the rotation of the shaft pivots each of the one or more shears about a respective axis, therein cutting each respective wire.

16. The wire terminating tool of claim 15, further comprising a battery operably coupled to the motor, wherein the battery is removably positioned within the handle.

17. The wire terminating tool of claim 1, further comprising a cutting apparatus configured to cut the plurality wires at a predetermined position, wherein the cutting apparatus comprises one or more of a roller cutter, diagonal cutter, blade, and shear operably coupled to the handle.

18. The wire terminating tool of claim 17, wherein the cutting apparatus comprises one or more cutters associated with each of the plurality of notches, wherein the one or more cutters are operably coupled to one or more levers and gears, and wherein the one or more levers and gears are operably coupled to one or more of a trigger mechanism and a motor, wherein the trigger mechanism and/or motor are configured to actuate the one or more cutters, therein cutting the plurality of wires.

19. The wire terminating tool of claim 17, wherein one or more of the seating apparatus and cutting apparatus comprises one or more of a motor, lever, gear, battery, switch, spring, and trigger mechanism.

20. A wire terminating tool, comprising:

a generally hollow handle comprising a first portion and a second portion, wherein at least one of the first portion and second portion comprise one or more cable guidance members extending along a predetermined length of an outer portion of the respective first portion and/or second portion, wherein the one or more cable guidance members are configured to engage a cable comprising a plurality of wires;

a positioning member fixedly coupled to the handle, wherein the positioning member comprises a plurality of notches associated with each of the first portion and second portion of the handle; and a wire retention member retractably coupled to the handle between the first portion and second portion thereof, wherein the wire retention member is configured to slidingly translate with respect to the positioning member between a load position and an unload position, wherein the wire retention member comprises:

a plurality of wire engagement slots having a binding member respectively positioned within each of the wire engagement slots;

one or more location members positioned at one or more ends of the wire retention member, wherein the one or more location members are configured to mate with a location feature of a termination block, and wherein in the load position, the wire retention member is configured to selectively secure each of the plurality of wires thereto in a respective one of the plurality of wire engagement slots, and wherein in the unload position, the wire retention member is retracted with respect to the positioning member, therein transferring the plurality of wires from the wire retention member to the plurality of notches in the positioning member, and wherein the positioning member is configured to position each of the plurality of wires in a respective terminal of the termination block;

a seating apparatus configured to seat the plurality of wires in the plurality of terminals, respectively, therein providing a metal-to-metal contact between the respective plurality of wires and plurality of terminals; and a cutting apparatus configured to cut the plurality wires at a predetermined position, wherein the cutting apparatus comprises one or more of a roller cutter, diagonal cutter, blade, and shear operably coupled to the handle.

* * * * *